US008138879B2

(12) United States Patent
Furuhata et al.

(10) Patent No.: US 8,138,879 B2
(45) Date of Patent: Mar. 20, 2012

(54) THERMAL OVERLOAD RELAY

(75) Inventors: Yukinari Furuhata, Konosu (JP); Fumihiro Morishita, Konosu (JP); Takeo Kamosaki, Konosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 248 days.

(21) Appl. No.: 12/659,007

(22) Filed: Feb. 23, 2010

(65) Prior Publication Data

US 2010/0245018 A1 Sep. 30, 2010

(30) Foreign Application Priority Data

Mar. 27, 2009 (JP) ..... 2009-079396

(51) Int. Cl.
*H01H 61/01* (2006.01)
*H01H 37/02* (2006.01)

(52) U.S. Cl. ..... 337/37; 337/36; 337/82; 337/55; 337/56; 337/78; 337/112; 335/35; 335/45; 335/145; 335/173; 361/93.8; 361/105

(58) Field of Classification Search ..... 337/36, 337/37, 55, 56, 78, 82, 84, 85, 94, 95, 112, 337/129, 319, 347, 357, 360, 361, 368, 392; 361/93.8, 105; 335/35, 45, 145, 173
See application file for complete search history.

(56) References Cited

U.S. PATENT DOCUMENTS 2,777,032 A * 1/1957 Burch ..... 337/91
3,015,007 A * 12/1961 Howard ..... 337/56
3,038,051 A * 6/1962 Howard ..... 337/62
3,162,739 A * 12/1964 Klein et al. ..... 335/9
3,183,328 A * 5/1965 Wheeler ..... 337/56
3,214,535 A * 10/1965 Koenig et al. ..... 335/37
3,251,966 A * 5/1966 Kussy et al. ..... 337/45
3,423,712 A * 1/1969 Howard ..... 337/77
3,588,761 A * 6/1971 Heft et al. ..... 335/16
3,800,260 A * 3/1974 Woodger ..... 337/49
4,536,726 A * 8/1985 Hideo ..... 335/23
4,603,312 A * 7/1986 Conner ..... 335/42
4,625,190 A * 11/1986 Wafer et al. ..... 335/20
4,635,020 A * 1/1987 Sako ..... 337/49
4,636,760 A * 1/1987 Lee ..... 335/14
4,642,598 A * 2/1987 Ichikawa et al. ..... 337/82
4,652,847 A * 3/1987 Sako ..... 337/49
4,670,728 A * 6/1987 Akiike et al. ..... 337/49
(Continued)

FOREIGN PATENT DOCUMENTS

DE 3544989 A1 * 7/1987
(Continued)

*Primary Examiner* — Anatoly Vortman
(74) *Attorney, Agent, or Firm* — Manabu Kanesaka

(57) ABSTRACT

A thermal overload relay includes main bimetals which bend upon detection of an overload current; a release lever displaced via movement of a shifter moved in response to the bending of the main bimetals; and a contact reversing mechanism for changing-over contacts responsive to a rotation of the release lever. The main bimetals, the release lever and the contact reversing mechanism are all disposed in a case. The contact reversing mechanism includes a pivotable movable plate; a reversing spring reversing the movable plate by coupling with a rotated release lever; and an interlock plate rotating around a support shaft together with the movable plate. Each contact has a normally opened contact piece and a normally closed contact piece and is disposed respectively in the vicinity of a front surface and in the vicinity of a back surface of the interlock plate.

2 Claims, 4 Drawing Sheets

U.S. PATENT DOCUMENTS 4,763,096 A * 8/1988 Ingrain ..... 337/82
4,785,274 A * 11/1988 Sako et al. ..... 337/49
4,808,961 A * 2/1989 Sako et al. ..... 337/49
4,814,737 A * 3/1989 Ebnet ..... 337/49
4,845,455 A * 7/1989 Sako et al. ..... 337/49
4,908,594 A * 3/1990 Akiike et al. ..... 337/49
4,912,598 A * 3/1990 Grass ..... 361/652
4,922,220 A * 5/1990 Livesey et al. ..... 337/82
4,983,939 A * 1/1991 Shea et al. ..... 335/42
5,046,227 A * 9/1991 Akiike et al. ..... 29/896.9
5,054,754 A * 10/1991 Akiike et al. ..... 267/159
5,767,762 A * 6/1998 Sako ..... 337/348
5,793,026 A * 8/1998 Kolberg et al. ..... 335/172
5,831,501 A * 11/1998 Kolberg et al. ..... 335/42
5,831,509 A * 11/1998 Elms et al. ..... 337/333
5,877,670 A * 3/1999 Sehlhorst et al. ..... 337/302
5,894,259 A * 4/1999 Kolberg et al. ..... 337/333
6,104,273 A * 8/2000 Larranaga et al. ..... 337/82
6,160,470 A * 12/2000 O'Carroll et al. ..... 337/82
6,225,881 B1 * 5/2001 Felden et al. ..... 335/172
6,445,274 B1 * 9/2002 Malingowski et al. ..... 337/49
6,459,355 B1 * 10/2002 Furuhata et al. ..... 337/52
6,496,097 B2 * 12/2002 Frank ..... 337/323
6,507,266 B1 * 1/2003 Bizard et al. ..... 337/349
6,515,569 B2 * 2/2003 Lias et al. ..... 337/37
6,570,481 B2 * 5/2003 Katsube et al. ..... 337/112
6,590,489 B1 * 7/2003 Ullermann et al. ..... 337/56
6,621,403 B2 * 9/2003 Nagahiro et al. ..... 337/75
6,661,329 B1 * 12/2003 Gibson ..... 337/84
6,720,856 B1 * 4/2004 Pellon et al. ..... 337/82
6,816,055 B2 * 11/2004 Weber ..... 337/82
7,135,953 B2 * 11/2006 Leitl et al. ..... 337/84
7,248,140 B2 * 7/2007 Yu ..... 337/94
7,372,356 B2 * 5/2008 Lee ..... 337/360
7,714,692 B2 * 5/2010 Lee ..... 337/84
7,821,376 B2 * 10/2010 Song ..... 337/84
7,868,731 B2 * 1/2011 Furuhata et al. ..... 337/84
2004/0085702 A1 * 5/2004 Ohkubo ..... 361/161
2008/0122563 A1 * 5/2008 Song ..... 335/176
2010/0245021 A1 * 9/2010 Furuhata et al. ..... 337/112
2010/0253467 A1 * 10/2010 Kamosaki et al. ..... 337/85

FOREIGN PATENT DOCUMENTS

JP H01-177849 12/1989
JP 2000-243203 A 9/2000
JP 2005044554 A * 2/2005
JP 2009043727 A * 2/2009
JP 2009-079396 2/2011

* cited by examiner

THERMAL OVERLOAD RELAY

BACKGROUND OF THE INVENTION AND RELATED ART STATEMENT

The present invention relates to a thermal overload relay for change-over of a contact upon detection of an overcurrent.

Japanese Examined Patent Publication No. H7-001665 (Patent Document 1), for example, discloses a thermal overload relay operated by detecting an overcurrent running in the main circuit.

The thermal overload relay of Patent Document 1 is described referring to FIG. 4.

This thermal overload relay comprises, in an insulator case 1 made of a resin mould, main bimetals 2 inserted in three phase electric circuit and wound with heaters 2*a*, a shifter 3 linked to free ends of the main bimetals 2 and movably supported on the insulator case 1, a switching mechanism 4 disposed in the insulator case 1 allowing linking to an end of the shifter 3, and a contact reversing mechanism 5 to changeover contacts by operation of the switching mechanism 4.

The switching mechanism 4 comprises a temperature compensation bimetal 7 linked to one end of the shifter 3, a release lever 8 fixed to the other end of the temperature compensation bimetal 7, and an adjusting cam 12 connected to the release lever 8 through a swinging pin 9 projecting at the lower end of the adjusting mechanism and abutting on the circumferential surface of an eccentric cam 11*a* of an adjusting dial 11, disposed rotatably in the insulator case 1 at the upper end of the adjusting cam 12. A rotation angle of the release lever 8 is set by varying an abutting position of the adjusting cam 12 on the circumferential surface of the eccentric cam 11*a* of the adjusting dial 11 through adjustment of the adjusting dial 11, thereby slightly rotating the adjusting cam 12 around a support shaft 13.

The contact reversing mechanism 5 comprises a reversing spring 14 fixed at its lower end to the release lever 8 and extending upwards, a slider 17 linking to the tip of the reversing spring 14 and moving a normally opened side movable contact piece 15*b* and a normally closed side movable contact piece 16*a*, and a reset bar 18 to manually move the slider 17 to a normal position. The reversing spring 14 is a member having a punched window (not shown in the figure) formed by punching a thin spring material, and a curved surface with a disc spring shape around the punched window. The reversing spring 14 is convexly curved towards right hand side in a normal state shown in FIG. 4.

When the bimetal 2 bends with the heat generated by the heater 2*a* due to an overcurrent in the above-described structure, the shifter 3 shifts to the direction indicated by the arrow P in FIG. 4 caused by displacement of the free end of the main bimetal 2. The Shift of the shifter 3 pushes a free end of the temperature compensation bimetal 7 and rotates the release lever 8 counterclockwise around the swinging pin 9.

With progression of the counterclockwise rotation of the release lever 8, the reversing spring 14 deforms bending convexly towards the left hand side. The deformation of the reversing spring 14 moves the slider 17, which is linked to the tip of the reversing spring 14, so as to change the normally opened side movable contact piece 15*b* and the normally opened side fixed contact piece 15*a* into a closed state and to change the normally closed side movable contact piece 16*a* and the normally closed side fixed contact piece 16*b* into an opened state.

Based on the information of the closed state of the normally opened side movable contact piece 15*b* and the normally opened side fixed contact piece 15*a*, and the information of the opened state of the normally closed side movable contact piece 16*a* and the normally closed side fixed contact piece 16*b* conducted by the reversing action of the switching mechanism 4, an electromagnetic contactor (not shown in the figures), for example, connected in the main circuit is opened to interrupt the overcurrent.

Meanwhile, in the contact reversing mechanism 5 of the conventional thermal overload relay described above, the slider 17 for change over of the normally opened contact (the normally opened side movable contact piece 15*b* and the normally opened side fixed contact piece 15*a*) and the normally closed contact (normally closed side movable contact piece 16*a* and the normally closed side fixed contact piece 16*b*) is placed flatly in the region over the main bimetals 2 in the insulator case 1. Moreover, the reversing spring 14 for moving the slider 17 is placed in a region different from the region for placing the slider 17. Therefore, a large space is required in, the insulator case 1, which is a problem in that it hinders a size reduction of a thermal overload relay.

In view of the above-described unsolved problems in the conventional technology examples, it is an object of the present invention to provide a thermal overload relay in which a space for placing a normally opened contact and a normally closed contact is reduced in the case, thereby minimizing the size of a thermal overload relay.

Further objects and advantages of the invention will be apparent from the following description of the invention.

SUMMARY OF THE INVENTION

In order to accomplish the above object, a thermal overload relay according to the present invention comprises a case; main bimetals which bend upon detection of an overload current; a release lever working according to displacement of a shifter that is displaced with the bending of the main bimetals; and a contact reversing mechanism for changing-over contacts by rotation of the release lever, wherein the all three latter members are disposed in the case. The contact reversing mechanism includes a movable plate supported at a support point at one end thereof and swingably at the other end; a reversing spring stretched between the other end of the movable plate and a spring support, the other end of the movable plate and the spring support being positioned opposite each other with respect to the support point, and reversing the movable plate by coupling with a rotated release lever; and an interlock plate rotating around a support shaft together with movement of the movable plate. The contacts each have a normally opened contact piece and normally closed contact piece and are respectively disposed in the vicinity of a front surface and in a vicinity of a back surface of the interlock plate.

According to the above-stated invention, the normally opened contact and the normally closed contact are changed-over by rotation of the interlock plate. These contacts are disposed in the vicinity of the front surface and the back surface of the interlock plate. Therefore, a space for placing the contacts in this case is significantly reduced as compared with the conventional device, thereby minimizing a size of the thermal overload relay.

According to the above-stated invention, even if external disturbances such as vibration and shock occur, the movable contact piece of the contacts in a closed state effectively never separates from the fixed contact piece, thereby avoiding an improper operation of the contacts.

In the thermal overload relay according to the invention, one of the normally opened contact and the normally closed contact has the movable contact piece on the other side of the movable plate, and the change-over of the movable contact piece and the fixed contact piece is carried out by transmitting rotation of the interlock plate on the movable plate as a load for the reversing action.

According to this invention, the number of parts of the thermal overload relay is reduced, and a space for disposition of the contacts is further reduced in this case.

In a thermal overload relay according to the present invention, the normally opened contact and the normally closed contact are changed-over by rotation of the interlock plate and are disposed in the vicinity of the front surface and the back surface of the interlock plate. Therefore, a space for placing the contacts in the case is significantly reduced as compared with the conventional device, thereby minimizing the size of the thermal overload relay.

BRIEF DESCRIPTION OF THE DRAWINGS

FIG. 2(*b*) is a drawing showing the contact reversing mechanism including the normally opened contact (a-contact) in a tripped state;

FIG. 3(*b*) is a drawing showing the contact reversing mechanism including the normally closed contact (b-contact) in a tripped state;

DETAILED DESCRIPTION OF PREFERRED EMBODIMENTS

Figure 4:
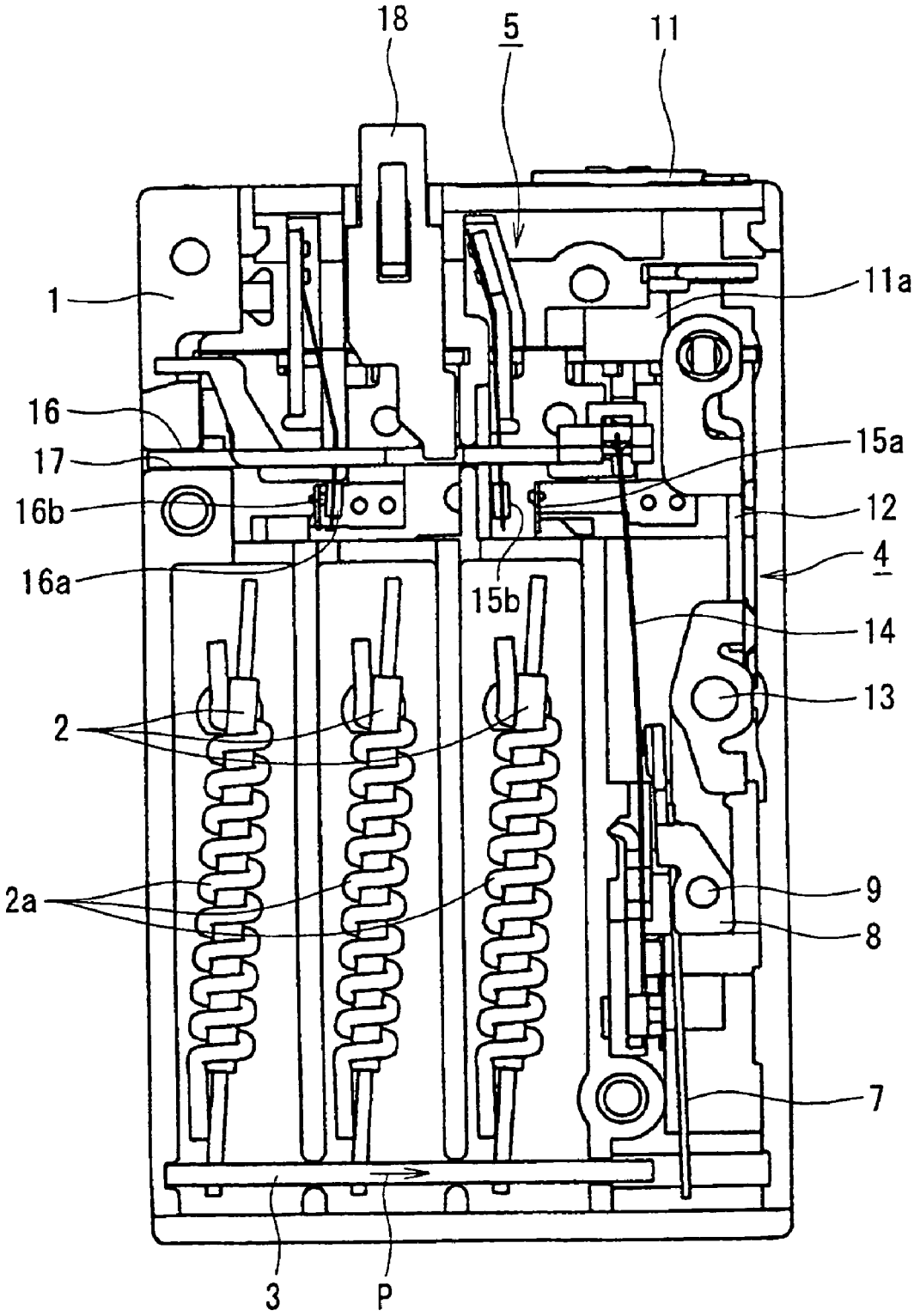
Fig. 4 Prior Art
FIG. 4 is a drawing showing essential parts of a conventional thermal overload relay in a normal state.

The following describes the best mode of preferred examples of embodiments of the invention in detail with reference to the accompanying drawings. The parts of the embodiment of the invention similar to the parts in FIG. 4 are denoted by the same symbols and their description is omitted.

Figure 1:
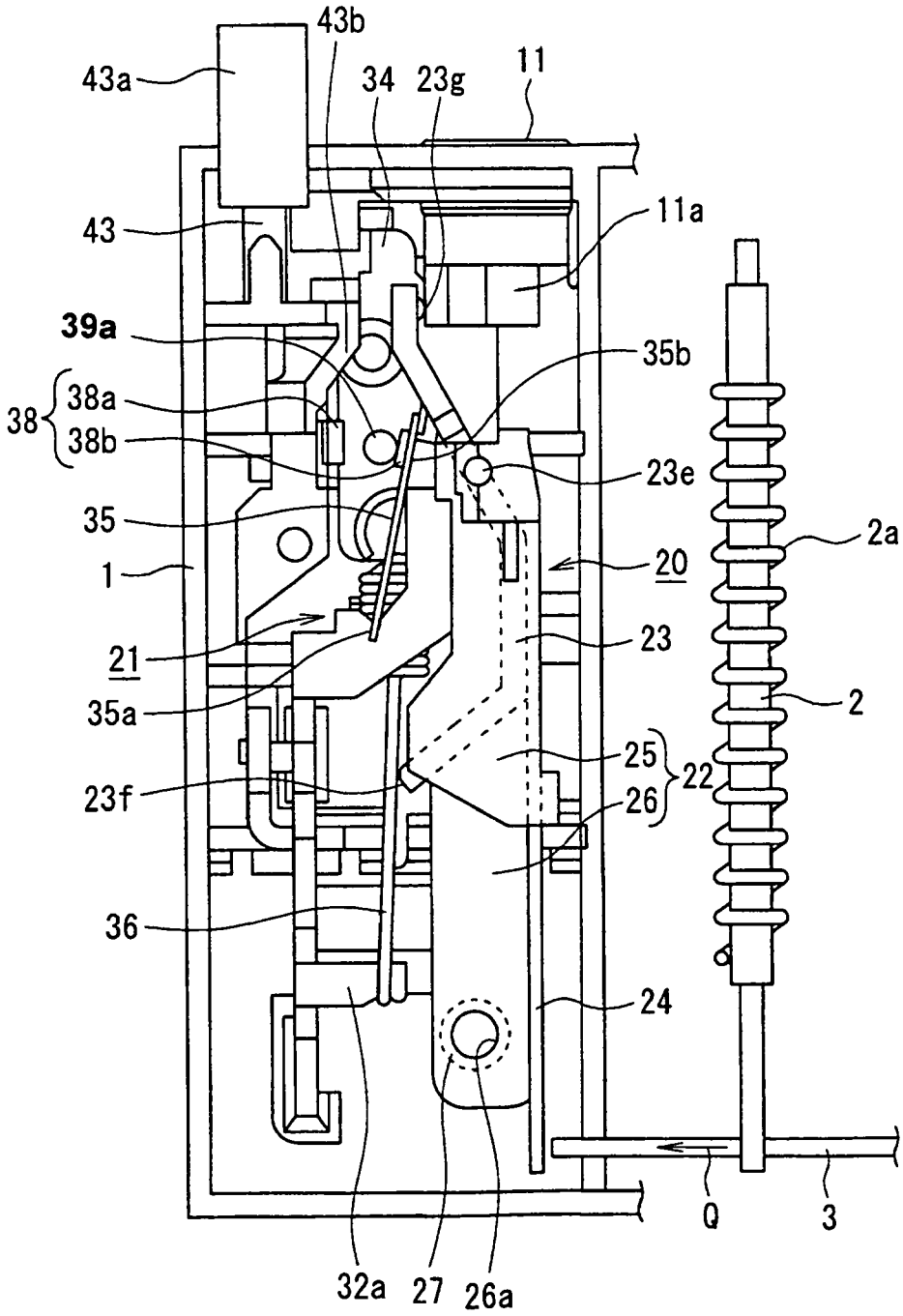
FIG. 1 is a drawing showing basic parts of a thermal overload relay according to the present invention in a normal state.
Figure 2A:
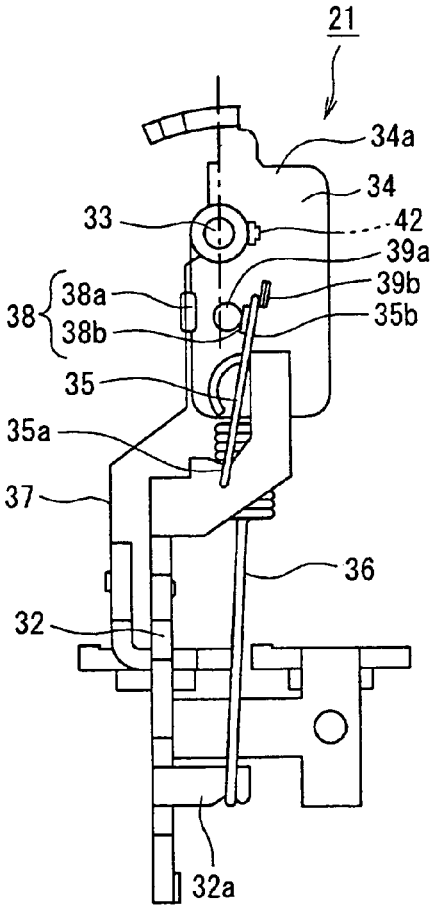
FIG. 2(*a*) is a drawing showing a contact reversing mechanism including a normally opened contact (a-contact) in the normal state.
Figure 2B:
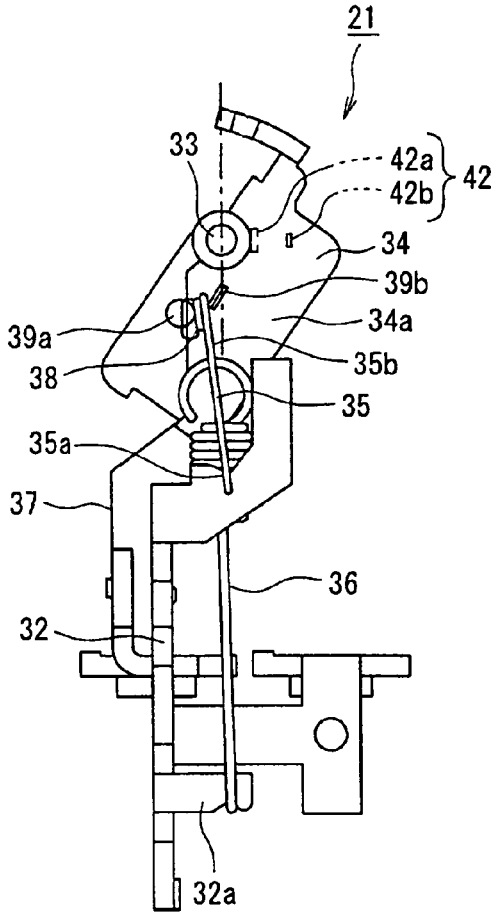
Figure 3A:
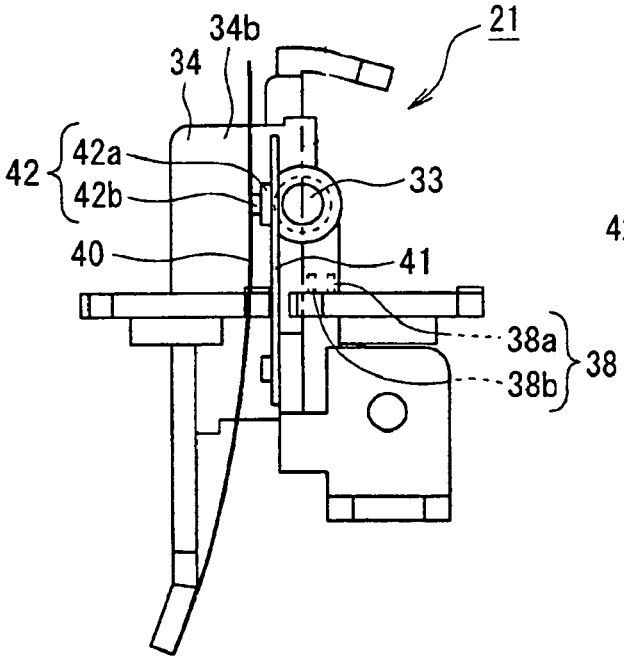
FIG. 3(*a*) is a drawing showing the contact reversing mechanism including a normally closed contact (b-contact) in the normal state.
Figure 3B:
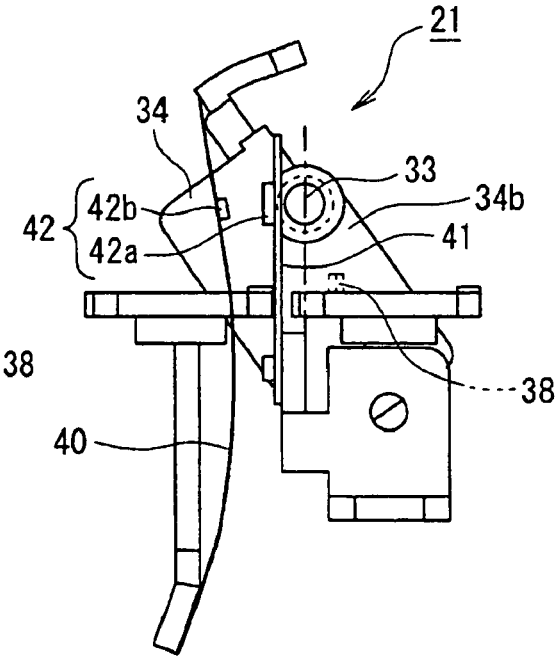

FIGS. 1 through 3 show an embodiment of a thermal overload relay according to the invention. FIG. 1 is a drawing showing essential parts in a normal state of a thermal overload relay according to the present invention; FIG. 2(*a*) is a drawing showing the contact reversing mechanism including a normally opened contact (a-contact) in the normal state; FIG. 2(*b*) is a drawing showing the contact reversing mechanism including the normally opened contact (a-contact) in a tripped state; FIG. 3(*a*) is a drawing showing the contact reversing mechanism including a normally closed contact (b-contact) in the normal state; and FIG. 3(*b*) is a drawing showing the contact reversing mechanism including the normally closed contact (b-contact) in a tripped state.

In the thermal overload relay of this embodiment, as shown in FIG. 1, in the insulator case 1 disposed are an adjusting mechanism 20 that works according to displacement of a shifter 3 linked to a free end of the main bimetals 2, a contact reversing mechanism 21 that changes-over contacts by an action of the adjusting mechanism 20, and a reset bar 43 for resetting the contact reversing mechanism 21.

The adjusting mechanism 20 comprises an adjusting link 22, a release lever 23 rotatably supported by the adjusting link 22, and a temperature compensation bimetal 24 fixed to the release lever 23 and linked to the shifter 3.

The adjusting link 22 is composed of a link support 25 supporting the release lever 23 and a leg part 26 extending downwards from one side of the link support 25.

A support shaft 27 is provided protruding from the inner wall at the lower part of the insulator case 1 into inside of the insulator case 1. A tip of the support shaft 27 having a reduced diameter is inserted into the bearing hole 26*a* of the leg part 26 and the whole adjusting link 22 is supported rotatably around the support shaft 27 of the insulator case 1.

The release lever 23 is provided with a rotating shaft 23*e* rotatably supported by a link support 25 of the adjusting link 22, and a reversing spring pushing part 23*f* formed in the portion of the release lever lower than the rotating shaft 23*e*, and a cam contacting part 23*g* is formed in the upper portion. The top end of a temperature compensation bimetal 24, a free end of which is located in a lower position, is fixed to the release lever 23.

The contact reversing mechanism 21 comprises, as shown in FIG. 2(*a*), a reversing mechanism support 32 disposed in the insulator case 1, an interlock plate 34 disposed in the vicinity of the reversing mechanism support 32 and rotatably supported on a support shaft 33 formed on the inner wall of the insulator case 1, a movable plate 35 with the upper portion 35*b* thereof disposed swingably around the lower portion 35*a* of the movable plate abutting on the reversing mechanism support 32. Further, a reversing spring 36 in the form of a tension coil spring is stretched between a coupling hole (not shown in the figure) formed in the side of the upper portion 35*b* of the movable plate 35 and a spring support 32*a* formed in the part of the reversing mechanism support 32 lower than the lower portion 35*a* of the movable plate 35.

The interlock plate 34 has a first linking pin 39*a* and a second linking pin 39*b* capable of linking with the movable plate 35 in the side of front surface 34*a* of the interlock plate 34. The first and second linking pins 39*a* and 39*b* induce the interlock plate 34 to rotate around the support shaft 33 in the reversing operation and the returning operation of the movable plate 35.

A normally opened contact (a-contact) side leaf spring 37 is provided on the reversing mechanism support 32 so that the free end of the normally opened contact (a-contact) side leaf spring 37 extends upwards. A fixed contact piece 38*a* of the a-contact 38 is fixed on the free end side of this leaf spring 37. A movable contact piece 38*b*, which is arranged to contact the fixed contact piece 38*a*, of the a-contact 38, is fixed on the upper portion 35*b* of the movable plate 35.

As shown in FIG. 3(*a*), on the back surface side 34*b* with respect to the intervening interlock plate 34, a normally closed contact (b-contact) side leaf spring 40 is disposed so that the free end thereof extends upwards. A contact support plate 41 is disposed facing this leaf spring 40. The movable contact piece 42*b* of the b-contact 42 is fixed on the free end side of the leaf spring 40, and the fixed contact piece 42*a* of the b-contact 42 to be connected to the movable contact piece 42*b* is fixed on the contact supporting plate 41.

The reset bar 43 comprises, as shown in FIG. 1, a reset button 43*a* that is manually pressed into the insulator case 1 and an angled surface 43*b* for returning the movable plate 35 that is in contact with the a-contact side leaf spring 37 and in a tripped state as shown in FIG. 2(*b*) to the initial position (normal state).

Now, operation of the thermal overload relay of the embodiment will be described.

When the main bimetal 2 is bent with the heat generated in the heater 2*a* by an overcurrent, displacement of the free end of the main bimetal 2 displaces the shifter 3 in the direction of arrow Q indicated in FIG. 1. When the free end of the temperature compensation bimetal 24 is pushed by the displaced shifter 3, the release lever 23 joined to the temperature compensation bimetal 24 rotates clockwise around the rotating shafts 23*d*, 23*e* supported by the adjusting link 22 and the reversing spring pushing part 23*f* of the release lever 23 pushes the reversing spring 36.

Due to the rotation of the release lever 23 in the clockwise direction, at the moment the pushing force of the reversing spring biasing part 23*f* exceeds the spring force of the reversing spring 36, the movable plate 35 starts to perform a reversing action around the lower part 35*a*. Accompanying the reversing action of the movable plate 35, the interlock plate 34, receiving the reversing action of the movable plate 35 transmitted through the first linking pin 39*a*, rotates around the support shaft 33 (see FIG. 2(*b*) and FIG. 3(*b*)).

As a result, the fixed contact piece 38*a* and the movable contact piece 38*b* of the a-contact 38 in the opened state shown in FIG. 2(*a*) are connected together, and the fixed contact piece 42*a* and the movable contact piece 42*b* of the b-contact 42 in the closed state as shown in FIG. 3(*a*) are separated away. Based on the information of the a-contact 38 and the b-contact 42, the electromagnetic contactor (not illustrated) is opened to interrupt the overcurrent in the main circuit.

Then, in the situation when the main bimetal 2 returns to the original configuration from the bent state after interruption of the main circuit current, the reset button 43*a* is pushed-in. With this manual reset operation of the reset bar 43, the angled surface 43*b* of the reset bar 43 exerts a resetting force through the a-contact side leaf spring 37 on the movable plate 35 in the tripped state shown in FIG. 2(*b*), thereby returning the movable plate 35 to the position of the initial state and at the same time, returning the interlock plate 34 to the position of the initial state (normal state) through the second linking pin 39*b*. Thus, the thermal overload relay is reset.

Now, effects of the thermal overload relay of the embodiment will be described.

In the contact reversing mechanism 21 of the embodiment, the a-contact 38 and the b-contact 42 are changed-over by rotation of the interlock plate 34 and the movable plate 35, and disposed in the vicinity of the front surface 34*a* side and the back surface 34*b* side of the interlock plate 34. Therefore, the space for placing the a-contact 38 and the b-contact 42 in the insulator case 1 is significantly reduced as compared with a conventional device, achieving size reduction of a thermal overload relay.

In addition, even if external disturbances such as vibration and shock come into the thermal overload relay, the movable contact piece 42*b* of the b-contact 42 in the closed state in the normal state shown in FIG. 3(*a*) is effectively never separated from the fixed contact piece 42*a*, preventing the contact from malfunctioning.

The movable contact piece 38*b* of the a-contact 38 is provided on the upper portion 35*b* of the movable plate 35 and change-over operation of the a-contact 38 is conducted with the reversing action of the movable plate 35. Consequently, the number of parts of the thermal overload relay is reduced, and in addition, the space for disposition of the a-contact 38 is decreased, thereby further reducing the size of the thermal overload relay.

In the embodiment described thus far, the a-contact 38 is changed-over by the reversing action of the movable plate 35. The reversing action of the movable plate 35, however, can change-over the b-contact.

The disclosure of Japanese Patent Application No. 2009-079396 filed on Mar. 27, 2009 is incorporated as a reference.

While the invention has been explained with reference to the specific embodiments of the invention, the explanation is illustrative and the invention is limited only by the appended claims.

What is claimed is:

1. A thermal overload relay comprising:

a case;

main bimetals which bend upon detection of an overload current;

a release lever rotating in accordance with a displacement of a shifter that is displaced in response to the bending of the main bimetals; and a contact reversing mechanism for changing-over contacts responsive to a rotation of the release lever;

the main bimetals, the release lever and the contact reversing mechanism being disposed in the case, and wherein the contact reversing mechanism comprises:

a movable plate supported at a support point at a first end thereof and swingably at a second end;

a reversing spring stretched between the second end of the movable plate and a spring support, the second end of the movable plate and the spring support being positioned opposite each other with respect to the support point, and reversing the movable plate by coupling with the rotated release lever; and an interlock plate rotating around a support shaft together with movement of the movable plate; and wherein each of the contacts has a normally opened contact piece and a normally closed contact piece and is disposed respectively in a vicinity of a front surface and in a vicinity of a back surface of the interlock plate.

2. The thermal overload relay according to claim 1, wherein one of the normally opened contact piece and the normally closed contact piece comprises a movable contact piece on an opposite side of the movable plate, and a change-over of the movable contact piece and the fixed contact piece is conducted by transmitting rotation of the interlock plate to the movable plate as a load for reversing action.

* * * * *